United States Patent [19]

Tygart

[11] 4,109,365

[45] Aug. 29, 1978

[54] METHOD FOR FORMING CONTOURED TUBING

[75] Inventor: Robert Carl Tygart, Rochester, N.Y.

[73] Assignee: Eastman Kodak Company, Rochester, N.Y.

[21] Appl. No.: 671,761

[22] Filed: Mar. 30, 1976

[51] Int. Cl.[2] ..... B23P 17/00; B21D 9/05

[52] U.S. Cl. ..... 29/421 R; 29/523; 72/62; 72/59

[58] Field of Search ..... 72/60, 62, 63, 56, 58, 72/59, DIG. 31; 29/157 T, 421 R, 523

[56] References Cited

U.S. PATENT DOCUMENTS

| | | | |
|---|---|---|---|
| 616,764 | 12/1898 | Bourke | 72/59 |
| 1,041,406 | 10/1912 | Baucroth | 72/62 |
| 2,603,175 | 7/1952 | Wurzburger | 29/157 T |
| 2,742,873 | 4/1956 | Moore | 72/62 |
| 2,965,961 | 12/1960 | Schindler | 29/421 R X |
| 3,148,940 | 9/1964 | Kojac | 29/523 X |
| 3,520,163 | 7/1970 | Otoda | 72/59 |
| 3,670,545 | 6/1972 | Kent | 29/157 T X |

*Primary Examiner*—Leon Gilden

*Attorney, Agent, or Firm*—Lawrence P. Kessler

[57] ABSTRACT

A method and apparatus for forming contoured tubular shapes, wherein the reshaping is accomplished without substantially changing the wall thickness of the tube material such that the strength of the resultant contoured shape is not effected. Forces are applied to an area of a tube in which the contour is to be changed. The forces are controlled so as to start reformation at one portion of the area and progress axially along the tube until the desired contour in that area is formed; that is to say, there is no incremental flowing increase (decrease) of tube diameter as the tube is contoured. No shaping forces are applied to the remainder of the tube (outside the area to be contoured); the tube material is thus free to move along its longitudinal axis relative to the area being contoured. This axial movement of the material forming the wall of the tube insures that there is substantially no change in wall thickness of the tube material through the area being contoured during the contour process. Therefore, hoop strength, immediately adjacent to a portion of the area undergoing contour change is maintained so that the tube material retains its strength in the area under linear tension.

8 Claims, 9 Drawing Figures

METHOD FOR FORMING CONTOURED TUBING

BACKGROUND OF THE INVENTION

1. Field of the Invention

This invention relates generally to forming contoured tubing and more particularly to contouring tubular stock in such a manner to maintain substantially uniform wall thickness so that the strength of the contoured tube is not effected.

2. Description of the Prior Art

Conventional techniques for forming tubing of variable cross-sectional contours include liquid bulging, electrohydraulic forming, and rubber punch bulging. These techniques are described in U.S. Pat. No. 3,520,163, issued Nov. 24, 1967 in the name of Otoda. Basically, in each technique, expansive forces are utilized to move tubular material into a mold or die having a complimentary surface to the desired finished tubular contour. A fourth technique for forming tubing involves the use of magnetic force fields to change the contour of tubular stock.

Of the known methods for contouring tubing, the simplest, in terms of necessary equipment, is rubber punch bulging. A solid ram is utilized to act on a rubber workpiece and thus the problems associated in working with hydraulic fluids under pressure are eliminated. Further the rubber workpiece, if properly selected, will return to its original shape to facilitate its removal from the contoured tubular shape. One drawback of rubber workpieces is that at the extreme pressures necessary to shape tubing, enough heat is generated to cause rapid deterioration of the rubber material. For this reason, polyurethane has been successfully used as a workpiece in place of rubber; see U.S. Pat. No. 3,670,545 issued June 20, 1972 in the name of Kent, et al.

In all of the above methods for forming contoured tubing, the wall thickness of the tube is altered thereby effecting the strength characteristics of the contoured tube. It is therefore important to control the forces being applied to contour the tube so as not to exceed the elongation factor of the tube material. If the elongation factor is exceeded substantial weakening of the material or, ultimately, tube rupture will occur.

SUMMARY OF THE INVENTION

Accordingly, this invention provides a method and apparatus which enables one to form contoured tubular shapes, wherein the reshaping is accomplished without substantially changing the wall thickness of the tube material such that the strength of the resultant contoured shape is not effected even if the elongation factor of the material is exceeded. Forces are applied to an area of a tube in which the contour is to be changed. The forces are controlled so as to start reformation at one portion of the area and progress axially along the tube until the desired contour in that area is formed; that is to say, there is an incremental flowing increase (decrease) of tube diameter as the tube is contoured. No shaping forces are applied to the remainder of the tube (outside the area to be contoured); the tube material is thus free to move along its longitudinal axis relative to the area being contoured. This axial movement of the material forming the wall of the tube insures that there is substantially no change in wall thickness of the tube material through the area being contoured during the contour process. Therefore, hoop strength, immediately adjacent to a portion of the area undergoing contour change is maintained so that the tube material retains its strength in the area under linear tension.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

In forming contoured tubing from sections of straight tubular stock, it has been the general procedure to determine the elongation factor of the material of the tube and then limit the contour change to less than 80% of the elongation factor in order to insure that a reduction in strength of the tube material to the point of rupture does not occur. For example, if the contoured tube is to be formed of 6061-0 aluminum, it is known that this particular material has an elongation factor of 25%. The safe range for expansion without rupture has therefore been considered to be 80% of 25%, or 20%. Thus, a tube of 2 inch diameter can safely be expanded to a diameter of 2.4 inches. However, it has been found that if the forming of the contour is particularly controlled so that reshaping takes place from one portion of the area to be contoured and moves progressively axially through the area, and if the portion of the tube not under reshaping forces is free to move along the axis of the tube, the contour change can be such that it will exceed the elongation factor of the material. The material in the free area moves relative to the area being reformed to maintain a nearly uniform wall thickness (equal to the original wall thickness) throughout the tube length. Maintenance of the wall thickness as the tube stock is being contoured assures that the hoop strength is retained adjacent to the portion of the tube just completing its diametrical reformation to keep the tube material below its rupture point in the area under linear tension. Utilizing the described principles the 6061-0 aluminum tubing has successfully undergone a contour change on the order of 30–35% without substantial loss of strength (the above mentioned 2 inch tube has been successfullly expanded to 2.625 inches).

Figure 1:
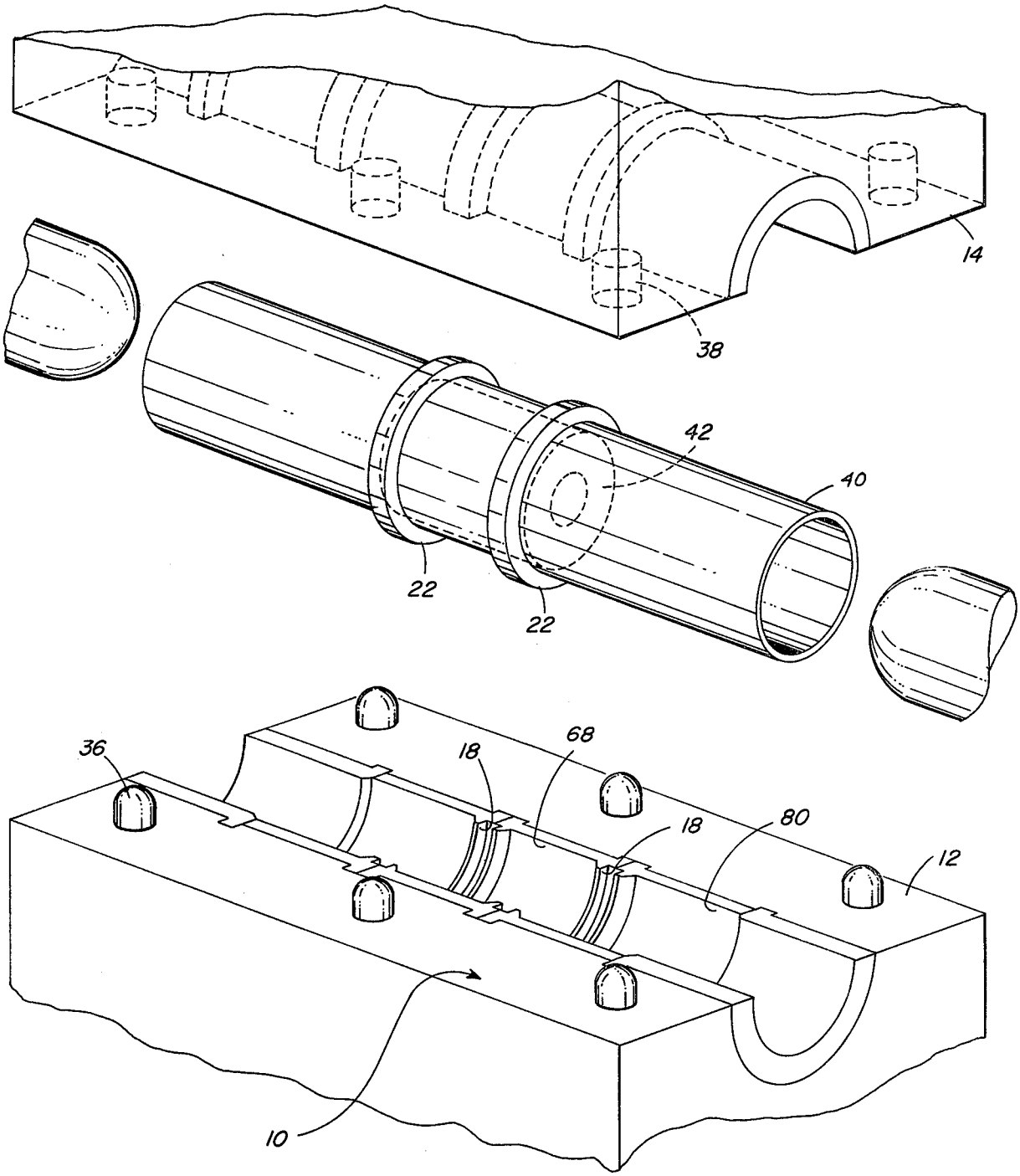
FIG. 1 is an exploded perspective view of an apparatus in accordance with this invention for forming a contoured tube supporting circumferential bearings.
Figure 2:
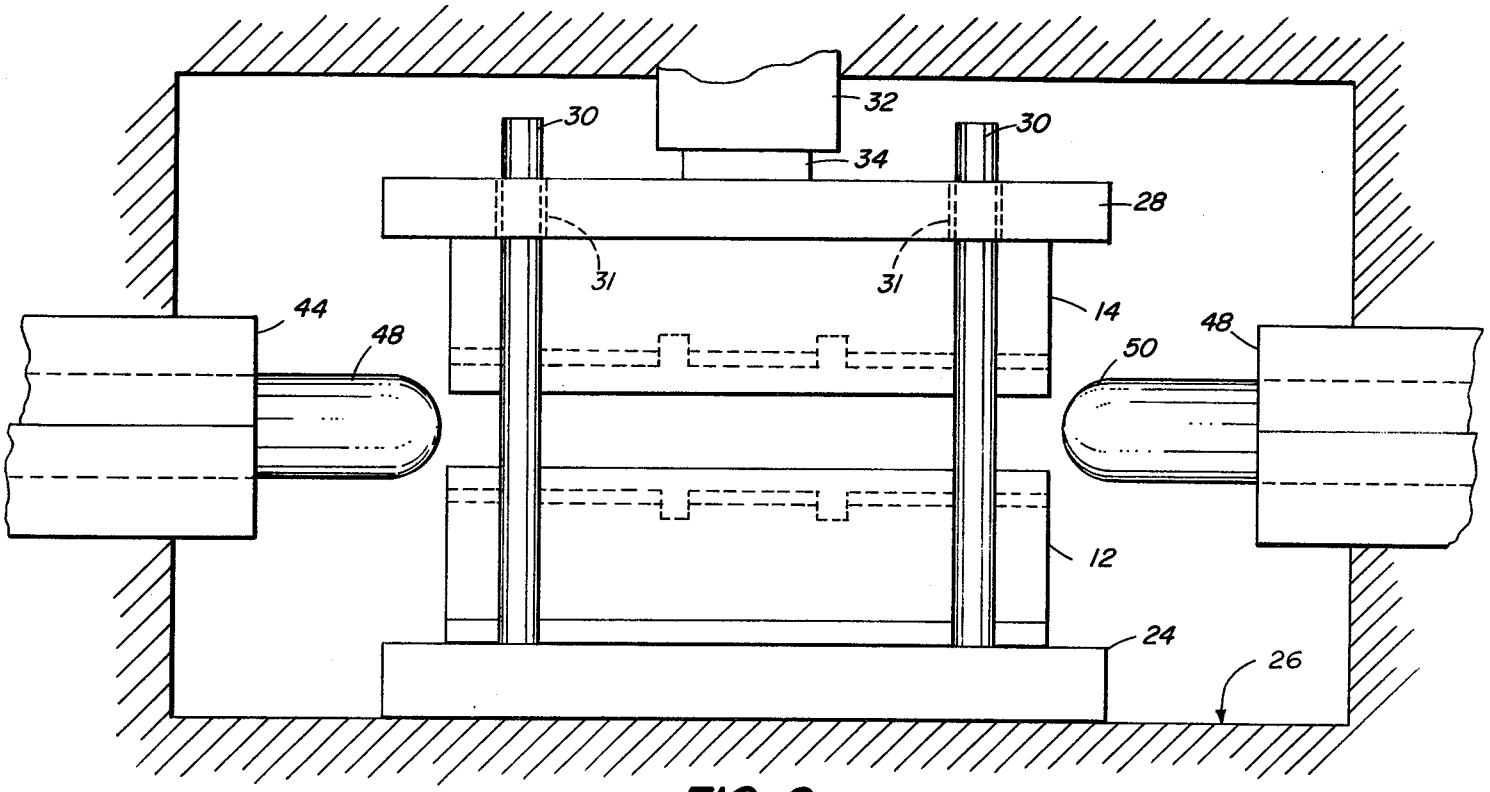
FIG. 2 is a side elevational view of the apparatus of FIG. 1.
Figure 9:
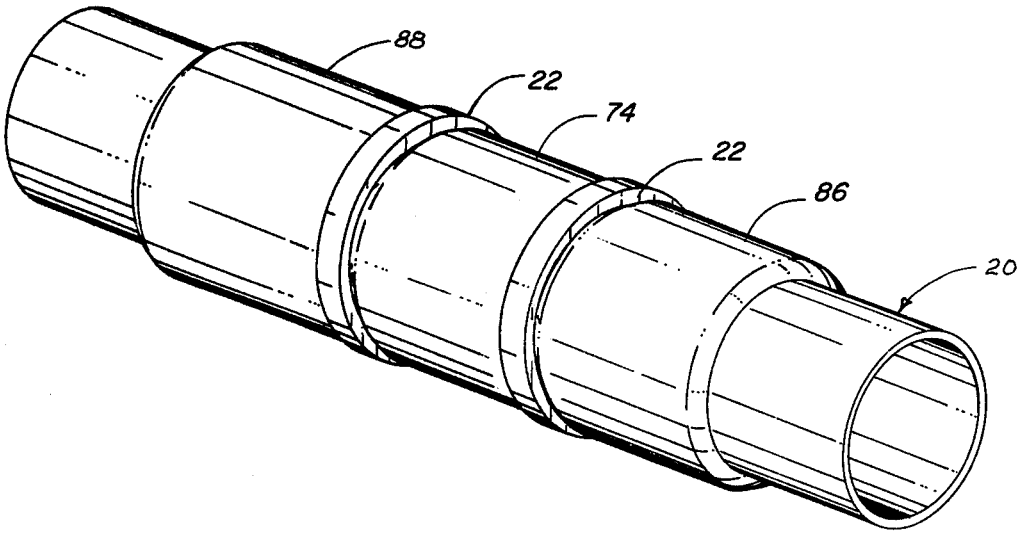
FIG. 9 is a perspective view of a completed contoured tube supporting circumferential bearings formed in the manner shown in FIGS. 5 through 8.

In order to illustrate the application of the above principles, an apparatus is shown in FIGS. 1 and 2 for forming a contoured tube 20 supporting circumferential bearings 22 (the desired resultant configuration of the tube 20 being shown in FIG. 9). The tube material may be any ductile material such as aluminum, stainless steel, brass or copper. The apparatus includes a split female die 10 having an upper die half 12 and a lower die half 14. Both halves of the die 10 support inserts 16 configured to be complimentary to the desired external configuration of the tube to be contoured, such as the bearing supporting tube 20. The inserts include nests 18 for supporting and locating the bearings 22 which are to be captured on the contoured tube. The bearings 22, may typically be ball bearings in upper and lower circumferential races, but may of course be of any suitable configuration.

The lower die half 12 is fixed to the bed 24 of a press 26. The upper die half 14 is fixed to a plate 28 guided in its vertical movement by columns 30 mounted on the bed 24 and extending through openings 31 in the plate 28. A ram 32 mounted in the press 26 has an extensible piston 34 connected to the plate 28 for raising and lowering the plate and for applying force to the upper die half 14 when the plate is in its lowered position. Male projections 36 on the lower die half 12 are positioned to mate with female indentations 38 in the upper die half 14 when the die 10 is closed by the ram 32 to insure proper alignment of the mated die halves.

As noted above, in order for the contour change of the tube being reshaped to exceed the normal elongation factor of the material of the tube stock, the reshaping of the tube material must begin in one portion of the area to be contoured and proceed progressively axially through that area. The section of tube stock 40 to be formed into the contoured bearing supporting tube is reshaped by a resilient substantially non-compressible elastomeric material such as a polyurethane workpiece 42. Suitable polyurethane is commercially available as for example from CONAP, Inc. of Olean, N.Y. It is supplied in solid shapes of varying hardness for machining to desired configurations or in liquid form for molding into desired configurations. Deformation of the workpiece 42 for contouring the tube stock 40 is controlled by independently operable rams 44 and 46 which have extensible pistons 48 and 50 respectively, the rams being mounted in the press 26. The pistons may have different lead end configurations to regulate the deformation of the workpiece to yield the progressive reshaping of the tube according to the principles of this invention.

Figure 3:
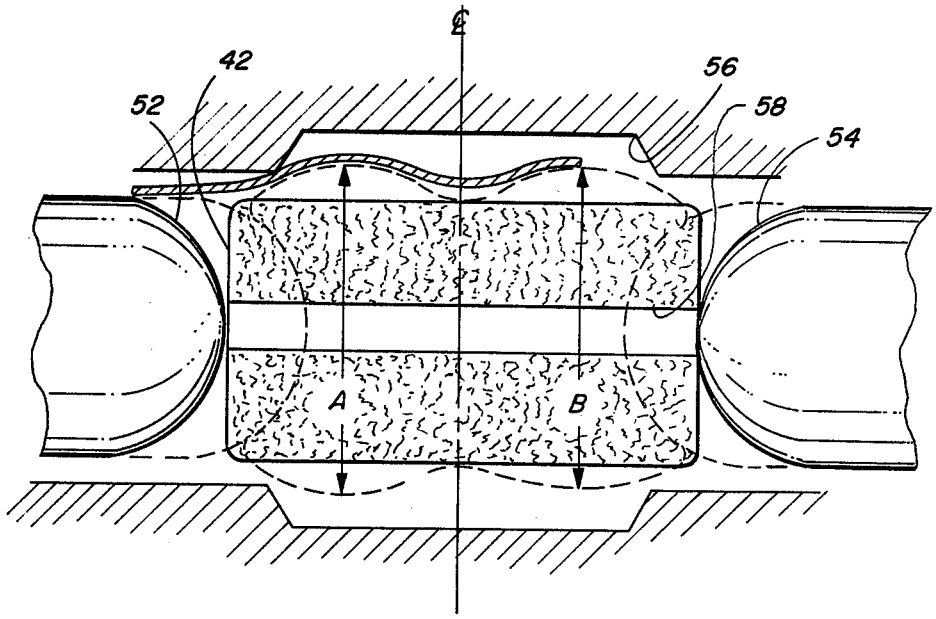
FIG. 3 is a side elevational view, partly in section, of an area of a tube being contoured, illustrating one method in accordance with this invention.
Figure 5:
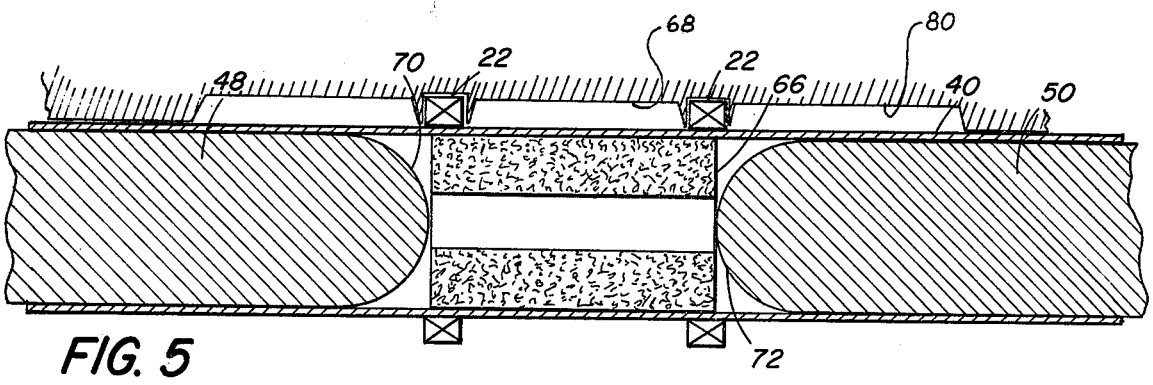
FIGS. 5 through 8 are side elevational views, partly in section, of a tube being contoured, illustrating the steps for forming a contoured tube supporting circumferential bearings according to this invention.
Figure 6:
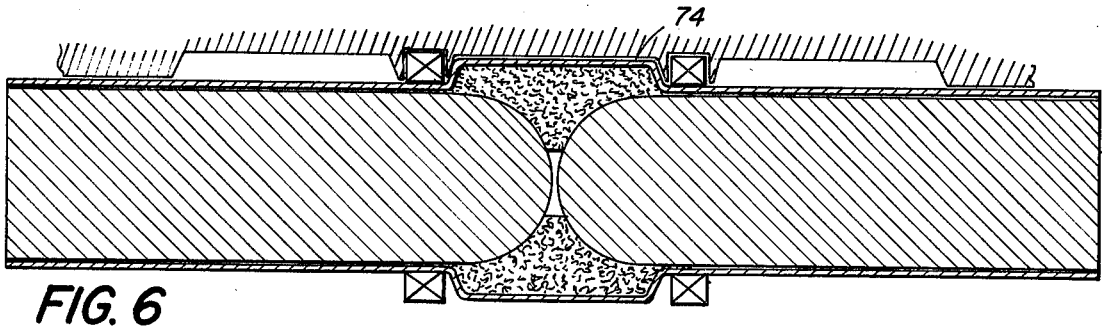

One method by which the progressive reshaping of the tube may be accomplished is shown in FIG. 3. The workpiece 42 is configured as a solid slug of polyurethane having a shore hardness of 85 to 90 on the A scale of a shore hardness machine. The slug has an axial bore 58 which enables the workpiece to rapidly dissipate heat which might otherwise cause deterioration thereof. The workpiece 42 placed radially concentrically adjacent to an area to be contoured. Equal forces are applied to the ends of the workpiece 42, by pistons 48 and 50 having solid spherical shaped lead ends 52 and 54 respectively. The forces applied to the workpiece 42 cause the workpiece to deform initially radially outwardly along the lines A and B adjacent to the ends of the workpiece (and the ends of the area 56 in the female die 10). This creates an expanding collet action on the internal surface of the tube stock 40. The radial expansion reforms the tube stock 40 into the internal cavity of the area 56. Continued movement of the pistons 48 and 50 along the longitudinal axis of the workpiece causes the deformation to progress axially from the ends of the area 56 to the center thereof (the radial deformation lines A and B moving incrementally toward the centerline L until the tube stock 40 conforms to the contour of the area 56. Friction forces between the surface of the workpiece 42 and the tube stock 40 draw tube material from the free area (outside the area to be contoured) axially toward the area being reformed thereby maintaining substantially uniform wall thickness and retaining the hoop strength of the tube. Due to the resiliency of the polyurethane, the workpiece has a memory which enables it to return to its original shape after the deformation forces are removed.

Figure 4:
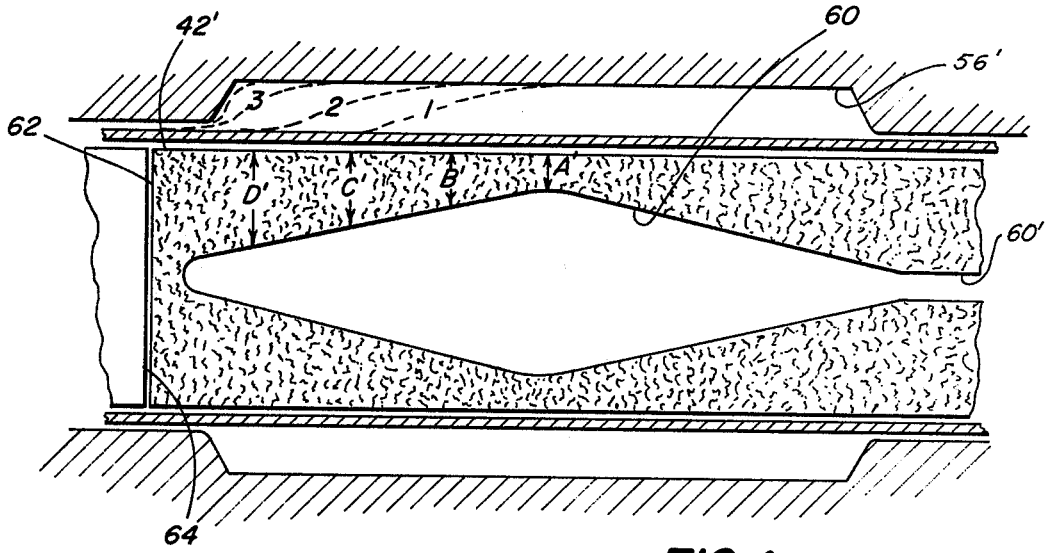
FIG. 4 is a side elevational view, partly in section, of an area of a tube being contoured, illustrating an alternate method of this invention.

An alternate method for progressively reforming a tube by a workpiece of another configuration is shown in FIG. 4. The workpiece, designated as numeral 42', is also made of polyurethane but is molded such that the interior of the workpiece 42' has a variable cross-sectional cavity 60 which communicates through an inlet 60' to a source of hydraulic pressure (not shown). The cavity 60 is configured to give the workpiece 42' a variable strength characteristic along its longitudinal axis. Thus when the workpiece 42' is positioned radially concentrically adjacent to an area 56' to be contoured and hydraulic pressure is supplied to the cavity 60, the workpiece will deform initially radially at the point A' in the center of the workpiece (and the center of the area 56' in the female die 10). With the end 62 of the workpiece 42' held stationary by a flat faced lead end 64 of the ram 48, continued pressurization of the cavity 60 will cause the radial deformation to progress axially in both directions, from the point A' through the points B', C', and D'. Accordingly, the tube stock 40 will be reformed progressively to the profiles 1, 2, 3 and 4 respectively until the tube conforms to the area 56' of the female die 10. As in the configuration of FIG. 3, friction forces between the surface of the workpiece and the tube stock (in this instance workpiece 42' and tube stock 40) draw tube material from the free area (outside the area to be contoured) axially toward the area being reformed thereby maintaining substantially uniform wall thickness and retaining the hoop strength of the tube. As above, the resiliency of the workpiece gives it a memory so that it will return to its original shape when the pressure is released.

In order to form the contoured tube 20 (FIG. 9) supporting the circumferential bearings 22, the procedure shown in FIGS. 5 through 8 is followed. A pair of circumferential bearings 22 are placed in the lower female die half 14, the bearings being supported in the nests 18. Tube stock 40, which remains relatively free for axial movement, is slipped through the bearings 22 into the lower die half 14. A polyurethane workpiece 66, similar to workpiece 42 of FIGS. 1 and 3, is inserted in the tube stock and positioned to be radially concentrically adjacent to the complimentary contoured cavity 68 of the female die 10 located between the nests 18. Pistons 48 and 50 of rams 44 and 46 are equipped with spherical shaped heads 70 and 72 respectively (similar to heads 52 and 54). The pistons 48 and 50 are moved into contact with the workpiece 66 (FIG. 5) and then, under equal pressure, are moved axially toward one another (FIG. 6) to deform the workpiece 66 for reshaping the section 74 of tube stock 40 between the bearings 22. The contour change in forming section 74 may well be taken beyond the normal rupture point of the material according to the principles discussed above relative to FIG. 3. When the pistons 48 and 50 are moved apart, after section 74 is fully formed, the workpiece, because of its memory property, substantially instantaneously returns to its initial size and shape and can be readily removed from the interior of the reshaped tube.

Figure 7:
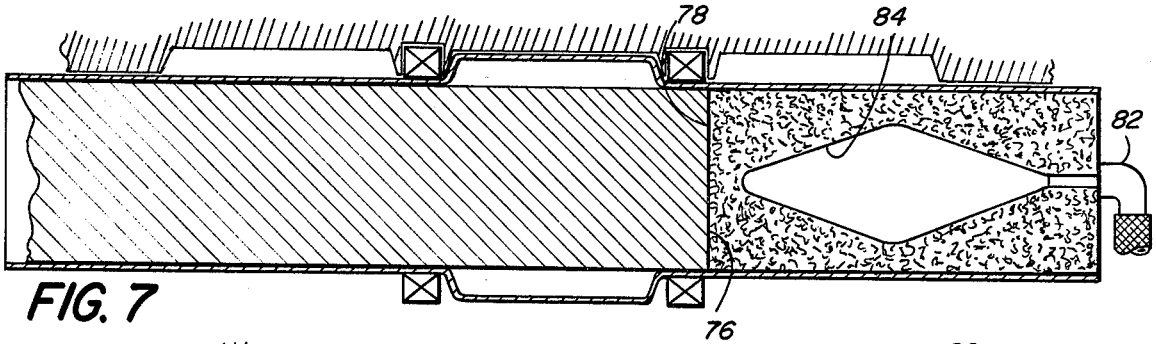
Figure 8:
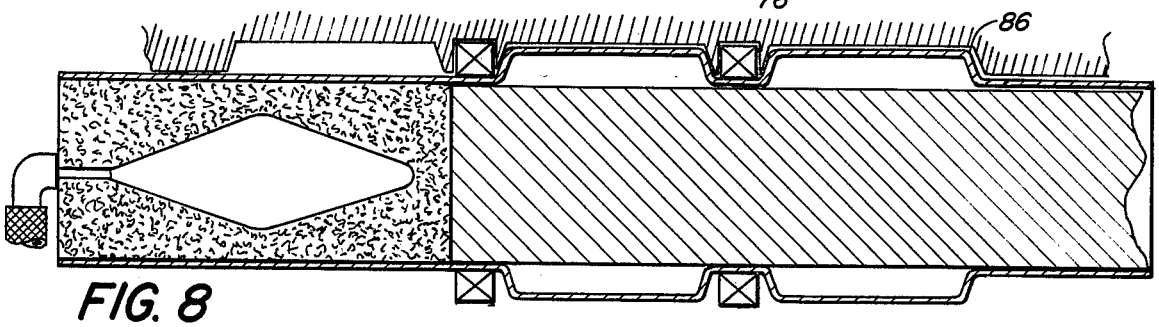

After the section 74 is formed, the lead end 70 of the piston 48 is replaced with a flat lead end 76. The piston 78 is then reinserted in the tube so that it underlies section 74 with the lead end 76 positioned substantially adjacent to the right hand bearing 22 (as viewed in FIG. 7). A polyurethane workpiece 78, similar to the workpiece 42' of FIG. 4 is inserted in the tube to abut the lead end 76 of the piston 48. The workpiece 78 will thus be positioned radially concentrically adjacent to the complimentary contoured cavity 80 of the female die 10. A fluid coupling 82 connects the cavity of the workpiece 78 to a source of hydraulic fluid (not shown) for selectively pressurizing the variable cross-sectional cavity 84. With the workpiece 78 properly positioned, the cavity 84 may be pressurized to deform the workpiece for reshaping the section 86 of the tube stock 40 to capture the right-hand bearing 22. The contour change in reforming section 86 may well be taken beyond the normal rupture point of the material according to the principles discussed above relative to FIG. 4. When the dydraulic pressure within the cavity 84 is released, after section 86 is fully formed, the workpiece 78, because of its memory property, substantially instantaneously returns to its initial size and shape so that it can be readily removed from the interior of the tube. After the workpiece 78 is removed, the arrangement of the piston and workpiece as shown in FIG. 7 is reversed (see FIG. 8) to enable the reshaping of the left hand section 88 of the tube stock 40 in the same manner as that which accomplished the formation of section 86. Upon conclusion of the formation of the section 88, the bearing supporting contoured tube 20 of FIG. 9 will be completed; i.e., the circumferential bearings 22 will be captured on the tube periphery in the precise position desired. The arrangement provides a simple method of manufacture for a single-piece tubular support capturing a pair of circumferential bearings in a way which has not been heretofore possible with known tube contouring techniques.

From the foregoing it is apparent that there is herein provided a techniquue for contouring tubing wherein reshaping is accomplished without substantially changing the wall thickness of the tube material. The portion of the tube outside the area to be contoured is free from shaping forces so that tube material may move along the axis relative to the area being contoured to maintain the desired substantially uniform wall thickness through the contoured area. Therefore, hoop strength is maintained immediately adjacent to the area being contoured which retains the strength of the tube material in the area under linear tension.

The invention has been described in detail with particular reference to preferred embodiments thereof, but it will be understood that variations and modifications can be effected within the spirit and scope of the invention.

I claim:

1. A method of forming tube stock into a tube having a contoured shape, comprising the steps of:

applying a deforming force to said tube stock in one portion of the area to be contoured while the remainder of the tube stock is free of said deforming force; and moving the deforming force incrementally along the longitudinal axis of the tube stock through the area to be contoured to form the contoured shape while that portion of the tube stock which is free of said deforming force moves axially relative to the tube stock into the area being contoured such that the hoop strength of the tube stock is substantially retained in the area immediately adjacent to the area being deformed.

2. A method of forming ductile tube stock into a tube having a contoured shape, comprising the steps of: placing the tube stock within a female die having an internal contour corresponding to the desired contoured shape of the tube; locating a resilient substantially noncompressible elastomeric workpiece within the tube stock adjacent to an area to be contoured; applying forces to the workpiece which cause said workpiece to expand radially in contact with the tube stock only in the area to be contoured, leaving the remainder of the tube stock free of the workpiece; and controlling said forces to radially expand the workpiece progressively along the tube stock to progressively expand the tube stock starting at one portion of the area to be contoured and continuing incrementally axially relative to the tube stock until the contoured shape is formed, while that portion of the tube stock which is free of the workpiece is drawn into the area being contoured to maintain substantially uniform wall thickness in the contoured tube, said wall thickness being substantially equal to the wall thickness of the tube stock thereby retaining the hoop strength of the tube stock.

3. The method of claim 2 wherein said forces are controlled to progressively expand the tube stock from the center of the area to be contoured toward the ends of said area.

4. The method of claim 3 further comprising: providing a workpiece having a cylindrical form and an internal chamber of uniformly varying cross-section along the longitudinal axis of the cylinder; and locating the cylindrical workpiece concentrically within the tube stock with the cross-section of least radial strength adjacent to the center of the area to be contoured; and wherein the step of applying forces to the workpiece comprises hydraulically pressurizing the internal chamber of the workpiece.

5. The method of claim 2 wherein said forces are controlled to progressively expand the tube stock from the ends of the area to be contoured toward the center of said area.

6. The method of claim 5 further comprising: providing a workpiece having a cylindrical form and a through-bore located along the longitudinal axis of the cylinder; locating the cylindrical workpiece concentrically within the tube stock; and wherein the step of applying forces to the workpiece comprises moving opposed spherically headed rams aligned with the through-bore within the tube stock toward one another in engagement with the workpiece.

7. The method of claim 2 further comprising:

locating a circumferential bearing on the tube stock in the area to be contoured and within said female die prior to applying forces to the workpiece; and wherein said forces are controlled to progressively expand the tube stock to provide a first hub on one side of said bearing and thence progressively expand the tube stock to provide a second hub on the opposite side of said bearing, said hubs serving to retain the bearing on the periphery of the tube stock.

8. A method of capturing a circumferential bearing on a tube between formed hubs comprising: placing a piece of ductile tube stock and at least one circumferential bearing in a female die having bearing supporting surfaces and an internal contour corresponding to the hubs which are to be formed adjacent to the bearing on the tube for capturing the bearing; locating a resilient substantially noncompressible elastomeric workpiece of an original size and shape within said tube stock radially of an area adjacent to the circumferential bearing; applying forces to said workpiece to expand the workpiece radially in contact with the tube stock only in the area adjacent to the bearing, leaving the remainder of the tube stock free of the workpiece; and controlling said forces to radially expand the workpiece progressively along the tube stock to progressively expand the tube starting at one portion of the area adjacent to the bearing and continuing incrementally axially relative to the tube stock until the first hub is formed while that portion of the tube stock which is free of the workpiece is drawn toward the first formed hub to maintain wall thickness in the tube, said wall thickness being substantially equal to the wall thickness of the tube stock thereby retaining the hoop strength of the tube stock; releasing the forces applied to the workpiece so that it returns to its original size and shape; and repeating the steps of locating the workpiece and applying, controlling, and releasing forces to the workpiece for forming the remaining hubs in the tube stock.

* * * * *